US008024828B2

(12) United States Patent
Nihei et al.

(10) Patent No.: US 8,024,828 B2
(45) Date of Patent: Sep. 27, 2011

(54) AIR CELL

(75) Inventors: Hideki Nihei, Hiratsuka (JP); Toshimitsu Ebinuma, Hiratsuka (JP); Hajime Satoh, Hiratsuka (JP); Hiromi Sanada, Tokyo (JP)

(73) Assignees: The Yokohama Rubber Co., Ltd., Tokyo (JP); The University of Tokyo, Tokyo (JP)

( * ) Notice: Subject to any disclaimer, the term of this patent is extended or adjusted under 35 U.S.C. 154(b) by 201 days.

(21) Appl. No.: 12/439,952

(22) PCT Filed: Aug. 30, 2007

(86) PCT No.: PCT/JP2007/066925

§ 371 (c)(1),
(2), (4) Date: Mar. 4, 2009

(87) PCT Pub. No.: WO2008/026701

PCT Pub. Date: Mar. 6, 2008

(65) Prior Publication Data

US 2010/0205745 A1 Aug. 19, 2010

(30) Foreign Application Priority Data

Aug. 30, 2006 (JP) ..... 2006-234608

(51) Int. Cl.
*A47C 27/10* (2006.01)

(52) U.S. Cl. ..... 5/654; 5/655.3; 5/710; 5/713

(58) Field of Classification Search ..... 5/654, 655.3, 5/710, 713

See application file for complete search history.

(56) References Cited

U.S. PATENT DOCUMENTS

| | | | | |
|---|---|---|---|---|
| 4,864,671 | A * | 9/1989 | Evans | 5/713 |
| 5,815,864 | A * | 10/1998 | Sloop | 5/706 |
| 6,154,907 | A * | 12/2000 | Cinquin | 5/713 |
| 6,715,174 | B2 * | 4/2004 | Tsai | 5/709 |
| 6,943,694 | B1 * | 9/2005 | Ellis | 340/666 |
| 7,409,735 | B2 * | 8/2008 | Kramer et al. | 5/713 |
| 2009/0144906 | A1 * | 6/2009 | Satoh et al. | 5/655.3 |

FOREIGN PATENT DOCUMENTS

| | | |
|---|---|---|
| JP | U 60-15324 | 2/1985 |
| JP | A 6-510436 | 11/1994 |
| JP | A 2000-279459 | 10/2000 |
| JP | A 2004-188173 | 7/2004 |
| JP | A 2005-261817 | 9/2005 |

* cited by examiner

*Primary Examiner* — Michael Trettel
(74) *Attorney, Agent, or Firm* — Greer, Burns & Crain, Ltd

(57) ABSTRACT

An object of the present invention is to provide an air cell which is capable of detecting that the upper end side and the lower end side of the air bag are nearer than a predetermined distance. This air cell has an air bag, a base member to which the lower end portion of the air bag is attached, an air chamber AR configured by the air bag and the upper surface of the base member, a thin film portion which forms the bottom surface of the air chamber and capable of deforming elastically in the up-and-down direction, an extending member configured to extend upwardly from the upper surface of the thin film portion, detecting means which is provided under the thin film portion and which detects downward deformation of the thin film portion.

12 Claims, 7 Drawing Sheets

AIR CELL

This application is a U.S. National Phase under 35 U.S.C. §371 of International Application No. PCT/JP2007/066925, filed Aug. 30, 2007.

TECHNICAL FIELD

The present invention relates to an air cell used by being mounted on the seating surface or bed to prevent bed sores which generate on a seating person or a patient, for example.

BACKGROUND ART

A generally known cushion using air cells having air cells provided so as to be arranged side by side with each along a seating surface, the air cells respectively consist of air bags which extend upward, a flexible base member configured so as to extend along the seating surface and support lower side of each of the air cells, an air passage for letting the interiors of the air cells communicate mutually. When a person sits down the air cells, air pressures in each of the air cells become equal mutually, and the pressure generated on the buttock of the seated person disperses.

With regard to the said cushion, air having a predetermined pressure is introduced into the air cells, and after the person is sat down on the air cells, air is bled from the air cells. With regard to the most collapsed one of the air cells, if an amount of air is controlled so that the upper end side of the air cell does not contact to the base member side, the pressure generated on the buttock of the seated person disperses effectively. However, it is difficult to confirm the state of collapse of the said air cells in the state in which the person is seated.

Therefore, a generally known cushion having air cells which consist of air bags extending upward, a first contact provided in the air bag of the air cell and attached to the upper end surface of the air bag, a second contact provided in the air cell and attached to the lower end side of the air bag, a judging portion provided outside the air cell, the judging portion which is connected with each contact and which judges whether the contacts connect to each other. When the upper side and the lower side of the air bag become nearer than a predetermined distance, the first contact and the second contact connect to each other, and the cushion detects that the upper side and the lower side of the air bag are nearer than the predetermined distance.

Patent Document 1: Japanese Patent publication 06-510436

Patent Document 2: U.S. Pat. No. 6,943,694

DISCLOSURE OF THE INVENTION

Problem to be Solved by the Invention

The latter cushion is provided with each contact in the air bag, and has the judging portion outside the air bag. Therefore, it is necessary to connect each contact and the judging portion by electrical wire. Thus, ensuring airtight state of the air cell becomes difficult by providing the said electrical wire, and the cost for manufacturing becomes high.

An object of the present invention is to provide a air cell capable of detecting that the upper side and the lower side of the air cell become equal to a predetermined distance or nearer than the predetermined distance and capable of being manufactured with lower manufacturing cost.

Means for Solving the Problem

To achieve the above object, with regard to an air cell used by being mounted on the seating surface or bed to prevent bed sores which generate on a seated person or a patient, the air cell in accordance with the present invention includes an air bag configured so as to be open at the bottom and to be able to contain air in its interior, a base member to which an opening edge portion of the air bag is attached, the base member which closes the opening portion of the air bag, a air chamber configured by air bag and the upper surface of the said base member, a thin film portion provided at the upper surface of the said base member which form a bottom surface of the air chamber, the thin film portion capable of elastically deforming in the up-and-down direction, an extending member provided in the air chamber, the extending member configured so as to extend upward from the upper surface of the thin film portion, and detecting means provided under the thin film portion, the detecting means for detecting downward deformation of the thin film portion.

By this, the thin film portion which is capable of elastically deforming is provided at the upper surface of the base member which forms a bottom surface of the air chamber, and the extending member is provided so as to extend upward from the upper surface of the thin film portion. Also, the detecting means is provided under the thin film for detecting downward deformation of the thin film portion. By this, when the air bag is collapsed and the upper end side of the air bag contacts to the extending member, also when the downward power is added to the extending member, the thin film portion is elastically deformed downwardly and the deformation is detected by the detecting means. The detecting means is provided under the thin film portion which forms the bottom surface of the air chamber, so the detecting means is located outside the air chamber.

Also, with regard to an air cell used by being mounted on the seating surface or bed to prevent bed sores which generate on a seated person or a patient, the air cell in accordance with the present invention includes an air bag configured so as to open at the bottom and to be able to contain air in its interior, a base member to which an opening edge portion of the air bag is attached, the base member which closes the opening portion of the air bag, a air chamber configured by air bag and the upper surface of the said base member, a thin film portion provided at the upper surface of the said base member which forms a bottom surface of the air chamber, the thin film portion capable of elastically deforming in the up-and-down direction, a movable member provided in the air chamber and disposed above the thin film portion, an urging member provided in the air chamber, the urging member supporting the movable member so as to be capable of moving in the up-and-down direction, the urging member capable of urging the movable member upward, and detecting means provided under the thin film portion, the detecting means for detecting downward deformation of the thin film portion.

By this, the thin film portion which is capable of elastically deforming is provided at the upper surface of the base member which forms a bottom surface of the air chamber, the movable member is located above the thin film portion. The movable member is supported so as to be capable of moving in the up-and-down direction, the movable member is urged upwardly by the urging member. Also, the detecting means is provided under the thin film for detecting downward deformation of the thin film portion. By this, when the air bag is collapsed and the upper end side of the air bag contacts to the extending member, also when the downward power is added to the extending member, the movable member moves downwardly against the urging force of the urging member. Also, the thin film portion is elastically deformed downwardly by abutting of the movable member and the deformation is detected by the detecting means. The detecting means is provided under the thin film portion which forms the bottom surface of the air chamber, so the detecting means is located outside the air chamber.

Effect of the Invention

According to the air cell of the present invention, when the air bag is collapsed and the upper end side of the air bag contacts to the extending member or the movable member, also when the downward power is added to the extending member or the movable member, the thin film portion is deformed downwardly and the downward deformation is detected by the detecting means. By this, it is possible to detect that the upper end side of the air bag and the upper surface of the base member is equal to the predetermined distance or nearer than the predetermined distance by appropriately setting up the shape of the extending member or the movable member and so on. Also, the detecting means is located outside the air chamber, so it is possible to connect the detecting means to other apparatuses easily. Therefore, it is extremely advantageous for reducing manufacturing costs.

The above and other objects, features, and advantages of the present invention will become more apparent from the following description and the accompanying drawings.

DESCRIPTION OF SYMBOLS

10 . . . air cell, 11 . . . air bag, 11*a* . . . cylinder-shaped portion, 11*b* . . . upper end surface, 11*c* . . . opening end portion, 12 . . . base member, 12*a* . . . upper protruded portion, 12*b* . . . vent, 12*c* . . . radial protruded portion, 12*d* . . . lower protruded portion, 12*e* . . . air passage, 12*f* . . . thin film portion, 12*g* . . . hole, 12*h* . . . protrusion, 13 . . . holding member, 14 . . . springy member, 14*k* . . . extending member, 20 . . . switch, 21 . . . body, 22 . . . button member, 23 . . . first contact member, 24 . . . second contact member, 31 . . . first electrical wire, 32 . . . second electrical wire, 40 . . . mount plate, 41 . . . penetrating hole, 50 . . . connecting pipe, 51 . . . rubber plug, 60 . . . switch, 61 . . . body, 62 . . . button member, 63 . . . first contact member, 64 . . . second contact member, 65 . . . third contact member, 71 . . . first electrical wire, 72 . . . second electrical wire, 73 . . . third electrical wire, H . . . buttock.

BEST MODE FOR CARRYING OUT THE INVENTION

Figure 1:
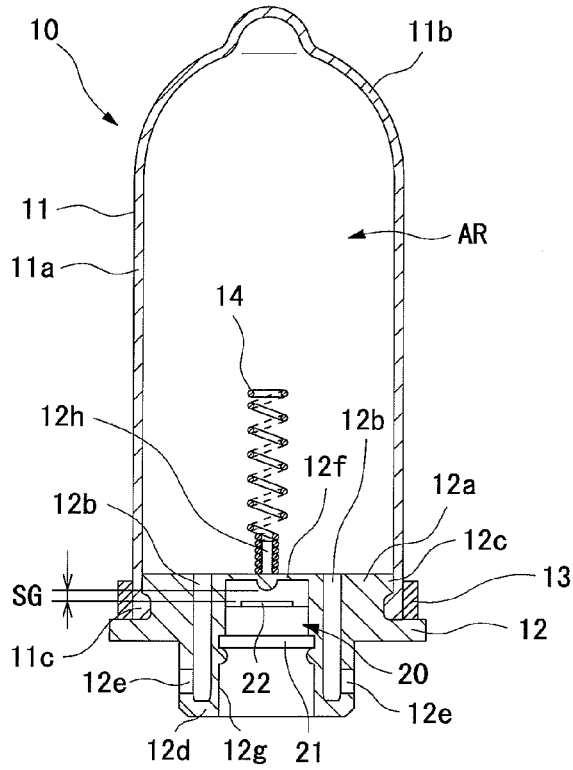
FIG. 1 is a side sectional view showing an embodiment of the present invention.
Figure 2:
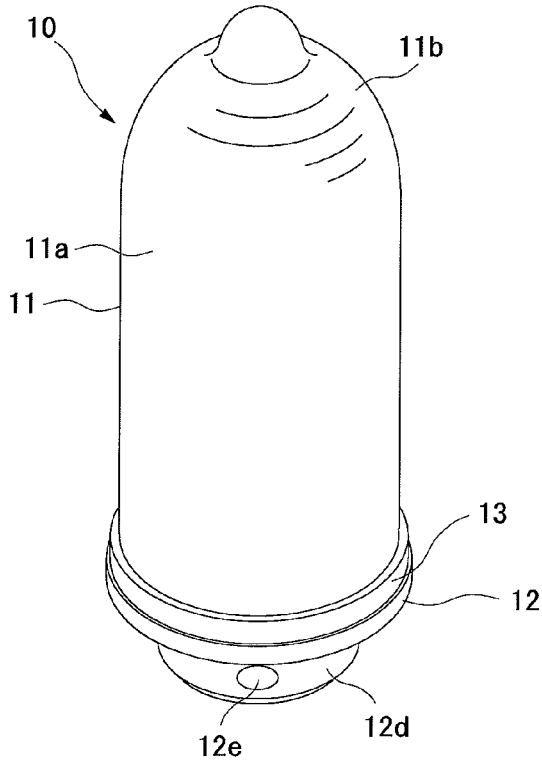
FIG. 2 is a perspective view of an air cell.
Figure 3:
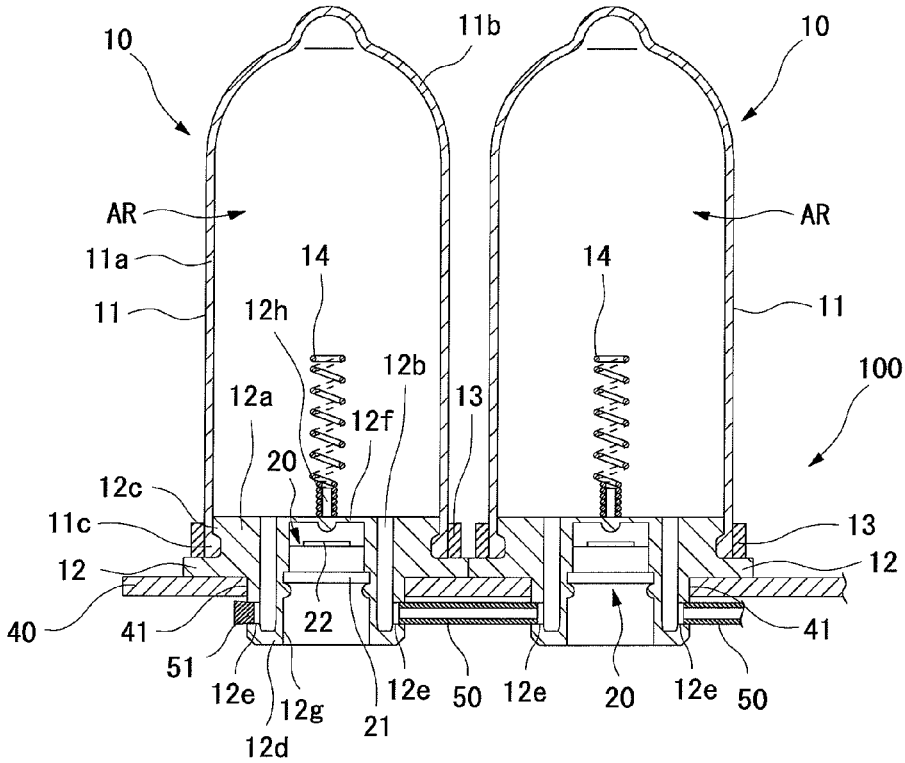
FIG. 3 is a part of a side sectional view of a cushion.
Figure 4:
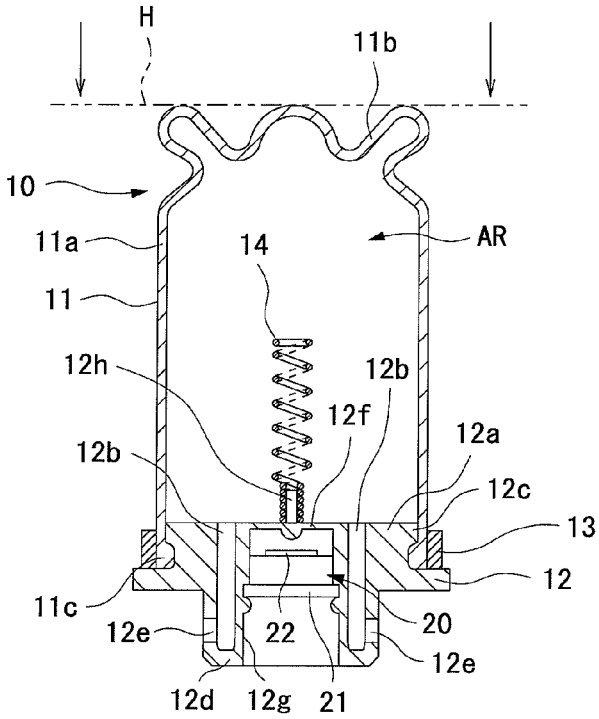
FIG. 4 is an operation view of the air cell at the time the air bag is collapsed by the buttock.
Figure 5:
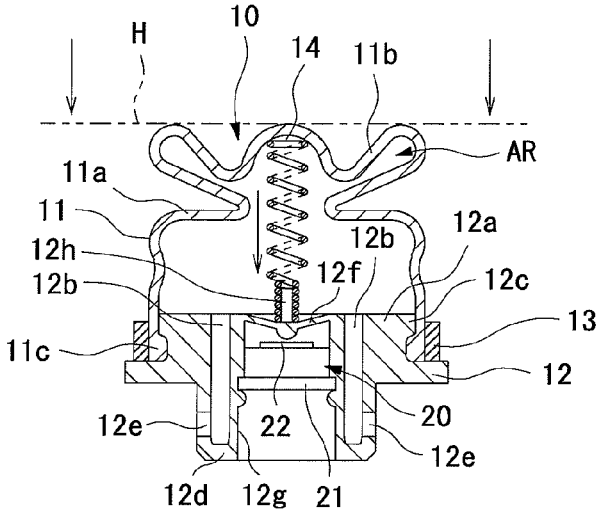
FIG. 5 is an operation view of the air cell at the time the air bag is collapsed by the buttock.
Figure 6:
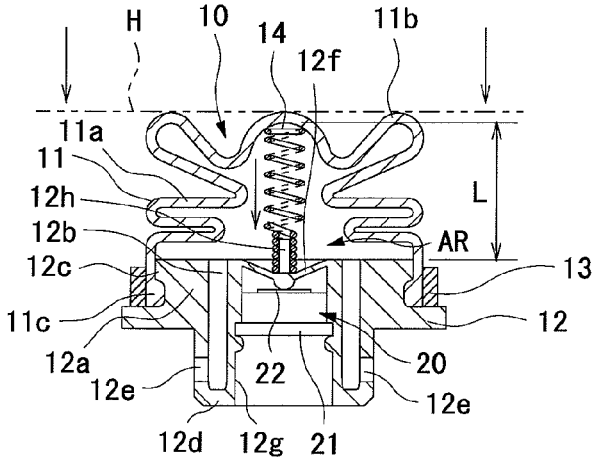
FIG. 6 is an operation view of the air cell at the time the air bag is collapsed by the buttock.
Figure 7:
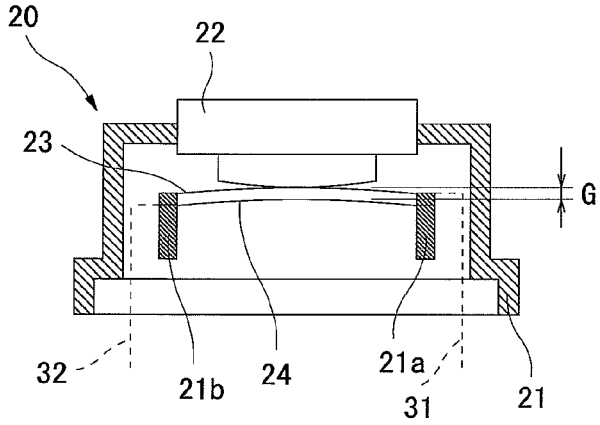
FIG. 7 is a side sectional view of a switch.
Figure 8:
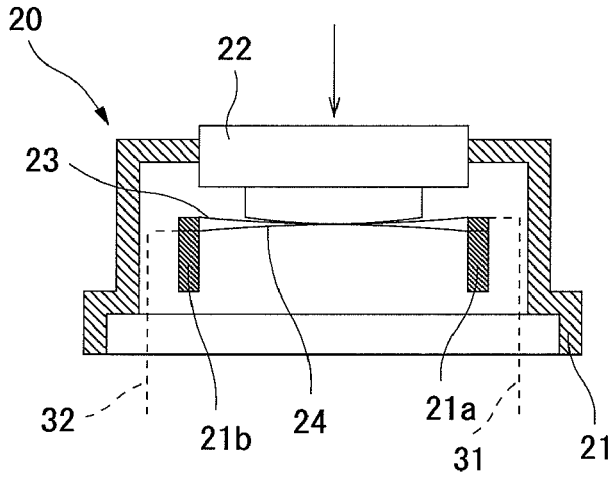
FIG. 8 is an operation view of the switch.

FIGS. 1 through 8 show a embodiment of the present invention. FIG. 1 is a side sectional view showing an embodiment of the present invention, FIG. 2 is a perspective view of an air cell, FIG. 3 is a part of a side sectional view of a cushion, FIGS. 4 through 6 are operation views of the air cell at the time the air bag is collapsed by the buttock, FIG. 7 is a side sectional view of a switch, FIG. 8 is an operation view of the switch.

The air cell 10 of this embodiment has an air bag 11 configured so as to be open at the bottom portion, a base member 12 to which the air bag 11 is attached so as to be easily put on and taken off, a holding member 13 which holds the air bag 11 to the base member 12.

The air bag 11 is made from flexible material such as soft rubbers or soft plastics and is capable of containing air in its interior. The air bag 11 has a cylinder-shaped portion 11*a* in which the sectional area is circular shape and which extends in the up-and-down direction, an upper end surface 11*b* configured so as to close the upper end of the cylinder-shaped portion 11*a*. The cylinder-shaped portion 11*a* is corresponding to the side wall of the air bag 11. The cylinder-shaped portion 11*a* and upper end surface 11*b* are made to thin film like shape having uniform thickness equal to or less than 1 mm. The lower end of the cylinder-shaped portion 11*a* is open, an opening end portion 11*c* which is the lower end of the cylinder-shaped portion 11*a* is thicker than another portion of the cylinder-shaped portion 11*a*, the opening end portion 11*c* is protruding toward radial inside compared to the inner peripheral surface of another portion of the cylinder-shaped portion 11*a*.

The base member 12 is made of rubbers or plastics which are harder than the material of the air bag 11, and the base member 12 is configured to circular plate shape. An upper protruded portion 12*a* is provided at the upper surface of the base member 12, the upper protruded portion 12*a* is protruding upwardly from the upper surface of the base member 12, the upper protruded portion 12*a* in which the sectional area is a circle shape. Four vents 12*b* are provided at the upper protruded portion 12*a*, each vent 12*b* is formed so as to extend in the up-and-down direction. Also, the upper protruded portion 12*a* is provided with the radial protruded portion 12*c* which is configured by forming the upper protruded portion 12*a* so that the outer surface at distal end side thereof is protruding toward radial outside compared to the outer surface at proximal end side thereof. The opening end portion 11*c* of the air bag 11 is attached to the outer surface of the upper protruded portion 12*a* by fitting, the inner surface of the opening end portion 11*c* abuts against the radial protruded portion 12*c* of the upper protruded portion 12*a* from a lower position. After the opening end portion 11*c* of the air bag 11 is fitted to the upper protruded portion 12*a*, if the holding member 13 is attached to the outer surface of the opening end portion 11*c*, the opening end portion 11*c* is pushed toward the upper protruded portion 12*a*. By this, the gap between the opening end portion 11*c* and the upper protruded portion 12*a* is sealed, an air chamber AR is formed by the air bag 11 and the upper surface of the upper protruded portion 12*a*.

The lower surface of the base member 12 is provided with an lower protruded portion 12*d* protruding downwardly, the sectional area of the lower protruded portion 12*d* is a circle shape. Four air passages 12*e* are provided at the lower protruded portion 12*d*, each air passage 12*e* is piercing from the outer surface of the lower protruded portion 12*d* to each vent 12*b*. Also, air passages 12*e* are arranged at the equal intervals mutually in the circumferential direction of the lower protruded portion 12*d*.

A thin film portion 12*f* is configured at the middle portion of the upper protruded portion 12*a* of the base member 12. The thin film portion 12*f* is configured with the base member 12 so as to be integrated and capable of deforming in the vertical direction. A hole 12*g* is provided under the thin film portion 12*f*, the hole 12*g* is configured so that its sectional area is a square shape. The hole is configured so as to extend in the up-and-down direction and open to the lower surface of the lower protruded portion 12*d*. The upper surface of the thin film portion 12*f* is provided with a protrusion 12*h*, so as to be integrated, which extends upwardly, the protrusion 12*h* is configured in a cylindrical shape. A springy member 14 is attached to the protrusion 12*h*, the springy member 14 is formed so as to extend upwardly from the upper surface of the thin film portion 12*f*. The springy member 14 is a metal coil spring. The springy member 14 is corresponding to the extending member in claims.

A switch 20 is attached in the hole 12*g*. The switch 20 is corresponding to the detecting means in claims. The switch 20 has a body 21 configured to a hollow shape, a button member 22 provided at the upper end of the body 21 so as to be capable of moving in the up-and-down direction, a first contact member 23 provided under the button member 22, a second contact member 24 provided under the first contact member 23.

The body 21 is made of insulation materials such as plastics, the body 21 has the outer shape slightly larger than the inner shape of the hole 12*g* of the base member 12. Thus, by fitting the body 21 to the hole 12*g* of the base member 12, the switch 20 is attached in the hole 12*g* of the base member 12 so as to be easily put on and taken off. Also, the switch 20 is attached to the base member 12 so that the lower surface of the thin film portion 12*f* is apart with a distance SG from the upper surface of the button 22 (refer to FIG. 1).

The button 22 is made of insulation materials such as plastics. The first contact member 23 is made of metal materials such as copper and formed to a thin plate shape. The first contact member 23 is abutting against the lower surface of the button member 22. One end of the first contact member 23 is supported by an one end support member 21*a* which is made of insulation materials, the other end of the first contact member 23 is supported by the other end support member 21*b* which is made of insulation materials. Also, a first electrical wire 31 is connected to the one end of the first contact member 23.

The second contact member 24 is made of metal materials such as copper and formed to a thin plate shape. The second contact member 24 is located at a position so as to be apart with a distance G from the lower surface of the first contact member 23. One end of the second contact member 24 is supported by the one end support member 21*a* so as to be insulated from the first contact member 23, the other end of the second contact member 24 is supported by the other end support member 21*b* so as to be insulated from the first contact member 23. Also, a second electrical wire 32 is connected to the other end of the second contact member 24.

A cushion 100 is formed by attaching a plurality of air cells 0 to a mount plate 40 so that the air cells 10 are arranged mutually in approximately horizontal direction (refer to FIG. 3). The mount plate 40 is made of rubbers or plastics which are harder than the materials of the air bag 11, the mount plate 40 is formed to a square shape, the area of the mount plate 40 is several decade times or several-hundred times as large as the area of each base member 12. The mount plate 40 is provided with a plurality of penetrating holes 41 which are penetrating the mount plate 40 in its thickness direction, the penetrating holes 41 has inner diameters slightly smaller than the outer diameter of the lower protruded portion 12*d* of each base member 12. When the lower protruded portion 12*d* of each base member 12 is inserted into each penetrating hole 41 downwardly from the upper surface side of the mount plate 40, the protruded portion 12*d* of each base member 12 is fitted to each penetrating hole 41. By this, each base member 12 is attached to the mount plate 40 so as to be easily put on and taken off. Also, the lower surface of each base member 12 abuts against the upper surface of the mount plate 40. By this, two or more air cells 10 are disposed on the mount plate 40 so that the air cells 10 are arranged mutually in approximately horizontal direction.

When the base members 12 are attached to the mount plate 40, the lower protruded portion 12*d* of each base member 12 protrudes toward the lower surface side of the mount plate 40. Also, each air passage 12*e* provided at the lower protruded portions 12*d* is located at the lower surface side of the mount plate 40. In this case, connecting pipes 50 are provided between base members 12, each connecting pipe 50 is inserted into the air passages 12*e* of the base members 12. By this, air passages 12*e* of the base members 12 are communicated through the connecting pipes 50, and the interiors of the air cells 10 mounted to the mount plate 40 are communicated with each other. Also, a rubber plugs 51 close air passages in which the connecting pipes 50 are not inserted. In this embodiment, the rubber plugs 51 closes the air passages 12*e* in which the connecting pipes 50 are not inserted. In another case, by configuring a number of air passages 12*e* on each base member 12 so that the said number is corresponding to the number of insertion of the connecting pipes 50, it is possible to omit works to close the air passages 12*e* by the rubber plugs 51.

The cushion 100 composed as mentioned above is used by being mounted on the seating surface of the wheelchair, for example. Also, when a person sits down on the cushion 100, air in the air cells 10 moves through the connecting pipes 51, and air pressures in the air cells 10 become equal with each other.

In this case, if the largest possible area of the lower surface side of the buttock H is supported by the air cells 10, the pressure added to the buttock H of the seated person is better dispersed. On the other hand, when the upper surface of the base member 12 and the upper end side of the air bag 11 of the most collapsed air cell 10 of all air cells 10 become nearer than a predetermined distance L (refer to FIG. 6), the air bag 11 become unable to support buttock H softly. Thus, by adjusting the amount of air in each air cell 10 so that the upper surface of the base member 12 and the upper end side of the air bag 11 of the most collapsed air cell 10 of all air cells 10 become slightly farer than the predetermined distance L, it is possible to effectively disperse the pressure added to the buttock H of the seated person.

Accordingly, when a person sits down on the cushion 100, firstly, a predetermined amount of air is introduced into each air cell 10 by electrical pump which is not shown in drawings. Secondly, after the person has sat down on the cushion 100, the air in the air cells 10 is discharged through a discharge valve which is not shown in drawings. By this, each air cell 10 collapses according to the shape of the buttock H of the seated person.

In this case, a part of the bottom surface of the air chamber AR of each air cell 10 is formed by the thin film portion 12*f* which is capable of deforming in the up-and-down direction, the springy member 14 is provided so as to extend upwardly from the upper surface of the thin film portion 12*f*. By this, when the upper end side of the air bag 11 of the most collapsed air cell 10 of all air cells 10 contacts to the springy member 14, downward force is added to the springy member 14. By this, the springy member 14 starts compressive deformation in the up-and-down direction, the thin film portion 12*f* starts elastic deformation downwardly. When the upper end side of the air bag 11 further moves downwardly, the springy member 14 further deforms compressively in the up-and-down direction, and the thin film portion 12*f* elastically deforms downwardly. Also, the lower surface of the thin film portion 12*f* abuts against the upper surface of the button 22, and button 12 moves the predetermined distance G downwardly by being pushed by the thin film portion 12*f* (refer to FIG. 6 and FIG. 8). By this, the middle portion of the first contact member 23 moves the predetermined distance G downwardly by the button 22, the first contact member 23 abuts against the second connecting member 24 (refer to FIG. 8). Thus, the first electrical wire 31 communicate electrically to the second electrical wire 32, the switch 20 detects that the deformation of the thin film portion 12*f* has become equal to or larger than the distance SG. Also, at the same time, the distance between the upper surface of the base member 12 and the upper end side of the air bag 11 of the air cell 10 has become the predetermined distance L.

By this, according to this embodiment, the upper end side of the air bag 11 abuts against the springy member 14 by collapsing of the air cell 10. Also, when the downward force is added to the springy member 14, the thin film portion 12*f* elastically deforms downwardly, the switch 20 detects the downward deformation of the thin film portion 12*f*. By this, by setting up the up-and-down direction size of the springy member 14, spring ratio of the springy member 14, spring ratio of the thin film portion 12*f*, the distance SG between the lower surface of the thin film portion 12*f* and the upper surface of the button member 22, and so on, it is possible to detect that the upper surface of the base member 12 and the upper end side of the air bag 11 is nearer than the distance L. For example, until one of the switches 20 of all air cells 10 detects the downward deformation of the thin film portion 12*f*, the discharge valve (not shown in drawings) discharges air in each air cell 10. After that, the pump (not shown in drawings) introduces a predetermined amount of air into each air cell 10. By this, it is possible to adjust the amount of air in each air cell 10 so that the distance between the upper surface of the base member 12 and the upper end side of the air bag 11 of the most collapsed air cell 10 of all air cell 10 becomes slightly larger than the predetermined distance L.

Also, the switch 20 is provided under the thin film portion 12*f* which forms a part of the bottom surface of the air chamber AR, the switch 20 is located outside the air chamber AR. Thus, it is possible to connect the switch and the other devices easily, so it is extremely advantageous for reducing product costs.

Also, the springy member 14 is configured so as to extend upwardly from the upper surface of the thin film portion 12*f*, the springy member 14 is configured so as to be capable of elastically deforming in the up-and-down direction. By this, after the button member 22 moves downwardly by the thin film portion 12*f*, if the upper end side of the air bag 11 further moves downwardly, movement of the upper end side of the air bag is allowed by elastic deformation of the springy member 14 in compressive direction. By this, large power is not added to the buttock H, it is extremely advantageous for supporting buttocks softly.

Also, the switch is provided with the button member 22 which moves downwardly by being pushed by the thin film portion 12*f* and first contact member 23, and the second contact member 24 which contacts to the first contact member 23 when the middle of the first contact member 23 moves downwardly the predetermined distance G. Thus, when the thin film portion 12*f* deforms downwardly the distance SG, the thin film portion 12*f* abuts against the upper surface of the button member 22. Also, the button member 22 and the first contact member 23 moves downwardly the predetermined distance G, the contact members 23 and 24 come into contact. Thus, it is possible to certainly detect the deformation of the thin film portion 12*f* by simple structure, it is extremely advantageous for reducing product costs.

In this embodiment, the switch 20 is located under the thin film portion 12*f*, deformation of the thin film portion 20*f* is detected by the switch 20. On the other hand, it is possible to provide a well known proximity sensor under the thin film portion 12*f*. Thus, it is possible to detect deformation of the thin film portion 12*f* by detecting that the distance between the proximity sensor and the thin film portion is equal to or less than a predetermined distance. Also, it is possible to detect deformation of the thin film portion by a well known optical sensor.

Also, it is possible to detect air pressures in each air cell 10 by providing pressure sensors capable of detecting air pressure in air chambers AR of the air cells 10. In this case, the pressure sensors are provided so as to penetrate the base member 12 and protrude in the air chambers AR. By this, in the state in which a predetermined amount of air has been introduced in air cells 10 which compose the cushion 100, when a person sits down on the cushion 100, air pressures in each air cell are respectively changed, changes of air pressures in each air cell 10 are detected. Therefore, the pressure distribution corresponding to the weight of the seated person and the shape of the buttock H is obtained.

Figure 9:
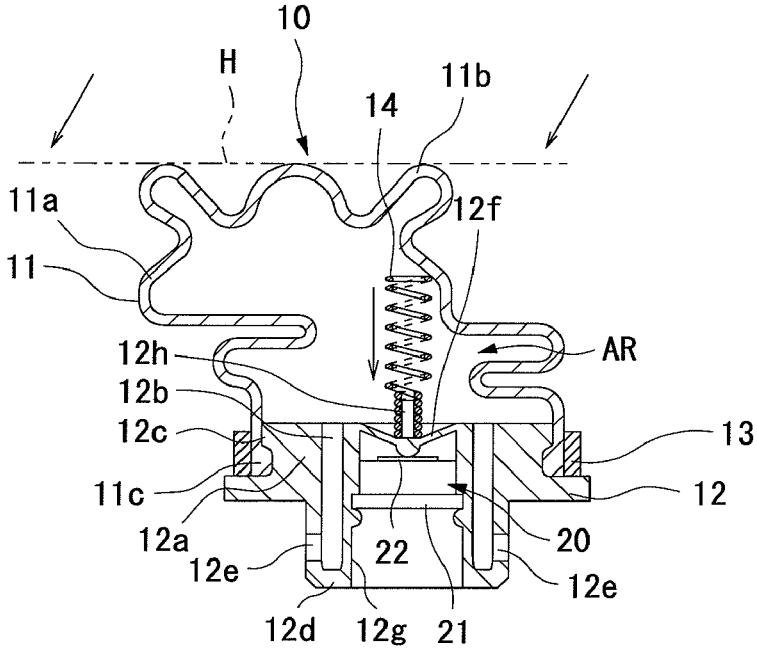
FIG. 9 is an operation view of the air cell at the time the air bag is collapsed by the buttock.
Figure 10:
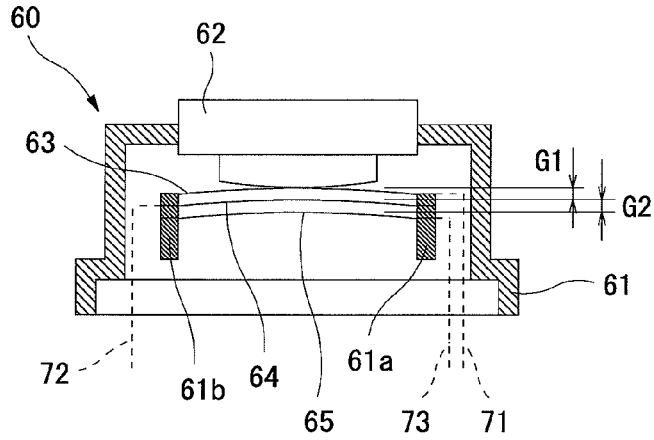
FIG. 10 is a side sectional view of the switch showing a first variation of the embodiment.
Figure 11:
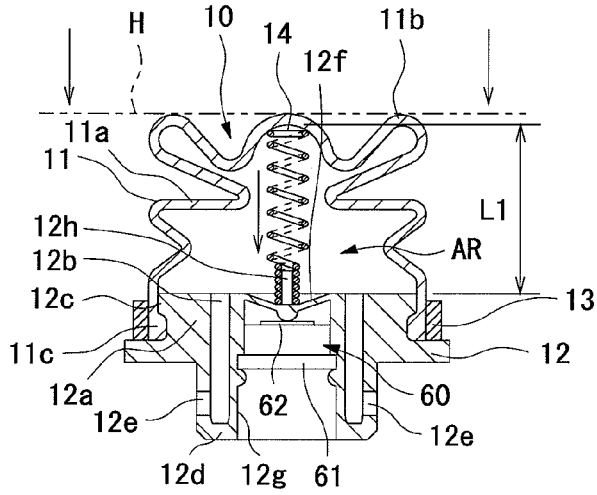
FIG. 11 is an operation view of the air cell showing the first variation of the embodiment.
Figure 12:
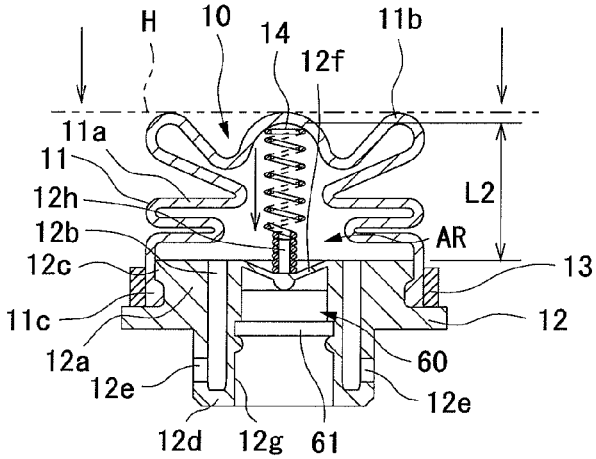
FIG. 12 is an operation view of the air cell showing the first variation of the embodiment.
Figure 13:
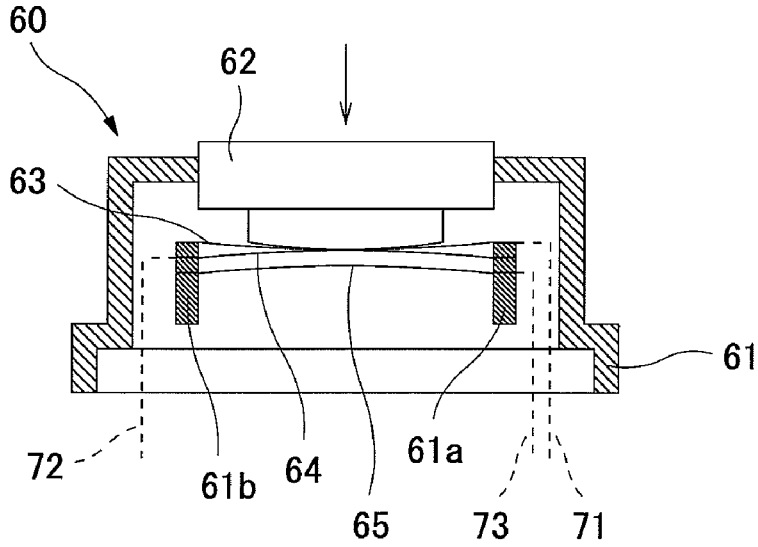
FIG. 13 is an operation view of the switch showing the first variation of the embodiment.
Figure 14:
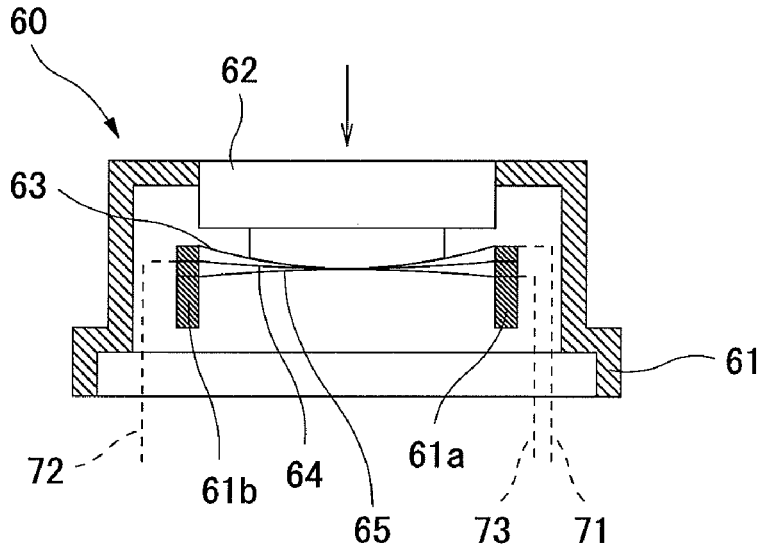
FIG. 14 is an operation view of the switch showing the first variation of the embodiment.
Figure 15:
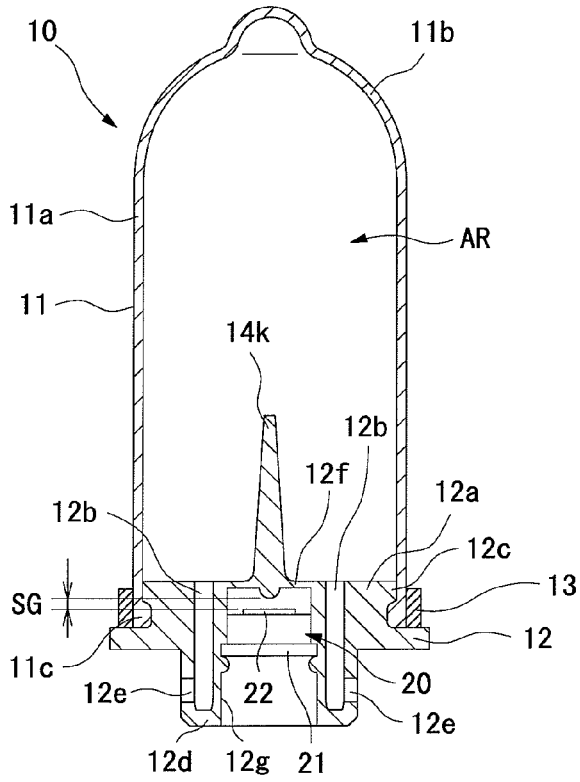
FIG. 15 is a side sectional view of the air cell showing a second variation of the embodiment.
Figure 16:
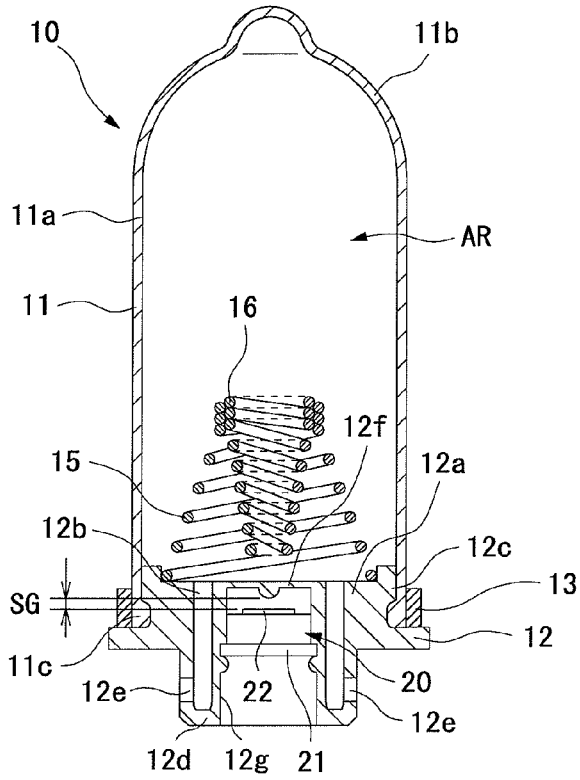
FIG. 16 is a side sectional view of the air cell showing a third variation of the embodiment.

In this embodiment, the case in which the upper end side of the air bag 11 moves simply downwardly was described. On the other hand, in the case in which the upper end side of the air bag 11 moves toward inclined downward direction, the cylinder-shaped portion 11*a* of the air bag 11 abuts against the springy member 14, and the downward power is added to the springy member 14. Thus, the thin film portion 12*f* elastically deforms downwardly, and the downward deformation of the thin film portion 12*f* is detected by the switch 20 (refer to FIG. 9). Thus, although there is a case in which the upper end side of the air bag 11 moves toward inclined downward direction according to the position of the seated person, in this case, the upper end side of the air bag 11 does not approach the upper surface of the base member 12 too much. It is extremely advantageous for supporting the buttock H softly.

Also, in this embodiment, the switch 20 is provided under the thin film portion 12*f*. On the other hand, as shown in FIG. 10 through FIG. 14, it is possible to provide a switch 60 instead of the switch 20. In this case, the switch 60 has a body 61 and a button member 62 which are equivalent to ones of the switch 20, a first contact member 63 provided under the button member 62, a second contact member 64 provided under the button member 64, a third contact member 65 provided under the button member 65.

The first contact member 63 is made of metal material such as copper and formed to a thin plate shape. The first contact member 63 is abutting against the lower surface of the button member 62. One end of the first contact member 63 is supported by an one end support member 61*b* which is made of insulation materials, the other end of the first contact member 23 is supported by the other end support member 61*b* which is made of insulation materials. Also, a first electrical wire 71 is connected to the one end of the first contact member 63.

The second contact member is made of metal materials such as copper and formed to a thin plate shape. The second contact member 62 is located at a position that is apart with a first predetermined distance G1 from the lower surface of the first contact member 63 (refer to FIG. 10). One end of the second contact member 64 is supported by the one end support member 61*a* so as to be insulated from the first contact member 23, the other end of the second contact member 64 is supported by the other end support member 61*b* so as to be insulated from the first contact member 63. Also, a second electrical wire is connected to the other end of the second contact member 64.

The third contact member 65 is made of metal materials such as copper and formed to a thin plate shape. The third contact member is located at a position that is apart with a second predetermined distance G2 from the lower surface of the second contact member 64. One end of the third contact member 65 is supported by the one end support member 61*a* so as to be insulated from the first contact member 63 and the second contact member 64, the other end of the third contact member 65 is supported by the other end support member 61*b* so as to be insulated from the first contact member 63 and the second contact member 64. Also, a third electrical wire 73 is connected to the one end of the third contact member 75.

In this case, if the upper end side of the air bag 11 contacts to the springy member 14, the springy member 14 starts deforming downwardly, the thin film portion 12*f* starts deforming downwardly. Moreover, if the upper end side of the air bag 11 moves downwardly, the springy member 14 is further deformed compressively in the up-and-down direction, the thin film portion 12*f* deforms downwardly. Also, the lower surface of the thin film portion 12*f* abuts against the upper surface of the button member 62 of the switch 60, the button member 62 and the first contact member 63 move downwardly the first predetermined distance G1 by being pushed by the thin film portion 12*f* (refer to FIG. 11). By this, the first contact member 63*b* contacts to the second contact member 64 (refer to FIG. 13). Thus, the first electrical wire 71 and the second electrical wire 72 communicate electrically with each other, the switch 60 detects that the downward deformation of the thin film portion 12*f* is equal to or more than the distance SG. Thus, the switch 60 detects that the upper end side of the air bag 11 and the upper surface of the base member 12 became nearer than the first predetermined distance L1.

When the upper end side of the air bag 11 further moves downwardly, the springy member 14 further compressively deforms downwardly, downward force is added to the button member 62, the first contact member 63 and the second contact member 64. The middle portion of the second contact member 64 moves the predetermined distance G2 downwardly by being pushed by button member 62 and the first contact member 63 from the upper position. By this, the second contact member 64 contacts to the third contact member 65, the second electrical wire 72 connects electrically with the third contact member 73. Thus, the switch 60 detects that the upper end side of the air bag 11 and the upper surface of the base member 12 has become nearer than the second predetermined distance L2.

In this case, if the second predetermined distance L2 is set up as a distance which is a limit capable of supporting the buttock H softly, it is possible that the switch 60 detects the distance between the upper end side of the air bag 11 and the upper surface of the base member 12 has become a distance between the first predetermined distance L1 and the second predetermined distance L2. In this case, if the distance between the upper end side of the air bag 11 and the upper surface of the base member 12 is equal to the distance between the first predetermined distance L1 and the second predetermined distance L2, the distance between the upper end side of the air bag 11 and the upper surface of the base member 12 becomes a little larger than the second predetermined distance L2. Thus, it is possible to prevent that the distance between the upper end side of the air bag 11 and the upper surface of the base member 12 becomes nearer than the second predetermined distance L2. Moreover, the amount of the air in each air cell 10 is easily adjusted so that the upper end side of the air bag 11 and the upper surface of the base member becomes slightly larger than the second predetermined distance L2.

In this embodiment, the springy member 14 which is configured so as to extend upwardly from the upper surface of the thin film portion 12*f* is provided. On the other hand, it is possible to provide a extending member 14*k* instead of the springy member 14 and the protrusion 12*h*. In this case, the extending member 14 is integrated with the thin film portion 12*f* and formed so as to extend upwardly from the upper surface of the thin film portion 14. When the upper end side of the air bag 11 contacts to the extending member 14*k*, and when the downward force is added to the extending member 14*k*, the thin film portion 12*f* deforms downwardly, the switch 20 detects the deformation of the thin film portion 12*f*. Thus, the switch 20 is capable of detecting that the distance between the upper end side of the air bag 11 and the upper surface of the base member 12 is nearer than the predetermined distance.

Also, in this embodiment, the springy member 14 which is configured so as to extend upwardly from the upper surface of the thin film portion 12*f* is provided. On the other hand, it is possible to provide a first springy member 15 and a second springy member 16 instead of the springy member 14. In this case, the first springy member 15 is made of coiled spring, and the first springy member 15 is configured to be capable of elastically deforming in the up-and-down direction. Also, the first springy member 15 is configured so that its winding diameter becomes gradually small from the lower side to the upper side. Also, the first springy member 15 is mounted on the upper surface of the upper protruded portion 12*a* of the base member 12. The second springy member 16 is made of coiled spring, the second springy member 16 is configured to be capable of elastically deforming in the up-and-down direction. Also, the second springy member 16 is configured so that its winding diameter becomes gradually small from the upper side to the lower side. The upper side of the second springy member 16 is attached to the upper side of the first springy member 15, the second springy member 16 is disposed above the thin film portion 12*f*. a predetermined gap is provided between the second springy member 16 and the thin film portion 12*f*. Thus, the second springy member 16 is supported above the thin film portion 12*f* by the first springy member 15 so as to be movable in the up-and-down direction, the first springy member 15 is capable of urging the second springy member 16 upwardly. The protrusion on the upper surface of the thin film portion 12*f* becomes unnecessary. The first springy member 15 is corresponding to the urging member in the claims, the second springy member 16 is corresponding to the movable member in the claims.

In this case, when the upper end side of the air bag 11 contacts to the first springy member 15 or the second springy member 16, the downward force is added to the first springy member 15 or the second springy member 16, the first springy member 15 starts downward deformation springily. When the upper end side of the air bag 11 further moves downwardly, the first springy member 15 further deforms compressively in the up-and-down direction, and the lower end of the second springy member 16 abuts against the thin film portion 12*f*. When the upper end side of the air bag 11 further moves downwardly, the first springy member 15 further deforms compressively in the up-and-down direction, and the thin film portion 12*f* elastically deforms downwardly. In this case, when the amount of the deformation of the thin film portion 12*f* becomes equal to or larger than the distance SG, the switch 20 detects the deformation of the thin film portion 12*f*. Thus, the switch 20 is capable of detecting that the distance between the upper end side of the air bag 11 and the upper surface of the base member 12 is smaller than the predetermined distance.

Also, the second springy member 16 is supported by the first springy member 15, the second springy member 16 is configured to be deformable in the up-and-down direction. By this, after the button member 22 has moved down by the thin film portion 12*f*, when the upper end side of the air bag 11 further moves down, but the second springy member 16 springily deforms in the compressive direction and permits the movement of the upper end side of the air bag. Thus, a large amount of force is not added to the buttock H, it is extremely advantageous for supporting the buttock H softly.

The preferred embodiments described in this specification are illustrative and not restrictive. The scope of invention is given by the appended claims, and all changes and modifications included in the meaning of claims are embraced in the present invention.

The invention claimed is:

1. An air cell used by being mounted on the seating surface or bed to prevent bed sores which generate on a seated person or a patient, the air cell comprising:

an air bag configured to be able to contain air in its interior and terminating at an opening end portion which defines an opening portion;

a base member to which the opening end portion of the air bag is attached, the base member being configured to close the opening portion of the air bag;

an air chamber configured by air bag and the upper surface of the base member;

a thin film portion provided at the upper surface of the base member which forms the bottom surface of the air chamber, the thin film portion capable of elastically deforming in the up-and-down direction;

an extending member provided in the air chamber, the extending member configured so as to extend upwardly from the upper surface of the thin film portion; and detecting means provided under the thin film portion, the detecting means for detecting downward deformation of the thin film portion.

2. The air cell according to claim 1, wherein the extending member is a springy member capable of deforming springily in the up-and-down direction.

3. The air cell according to claim 1, wherein the movable member is a springy member capable of deforming springily in the up-and-down direction.

4. The air cell according to claim 1, wherein the detecting means has:

a first contact member which moves downwardly by being pushed by the thin film portion from the upper side; and a second contact member to which the first contact member which has moved downwardly contacts.

5. The air cell according to claim 1, wherein the detecting means has:

a first contact member which moves downwardly by being pushed by the thin film portion from the upper side;

a second contact member to which the first contact member which has moved downwardly contacts, the second contact member which moves downwardly by being pushed by the first contact member from the upper side; and a third contact member to which the second contact member which has moved downwardly contacts.

6. The air cell according to claim 1, wherein the detecting means is capable of detecting that a distance between the detecting means and the thin film portion is equal to or smaller than a predetermined amount.

7. The air cell according to claim 1, further comprising:

a pressure sensor capable of detecting the pressure of the air in the air chamber.

8. An air cell used by being mounted on the seating surface or bed to prevent bed sores which generate on a seated person or a patient, the air cell comprising:

an air bag configured to be able to contain air in its interior and terminating at an opening end portion which define an opening portion;

a base member to which the opening end portion of the air bag is attached, the base member being configured to close the opening portion of the air bag;

an air chamber configured by air bag and the upper surface of the base member;

a thin film portion provided at the upper surface of the base member which forms the bottom surface of the air chamber, the thin film portion capable of elastically deforming in the up-and-down direction;

a movable member provided in the air chamber and disposed above the thin film portion;

an urging member provided in the air chamber, the urging member supporting the movable member so as to be capable of moving in the up-and-down direction, the urging member capable of urging the movable member upwardly; and detecting means provided under the thin film portion, the detecting means for detecting downward deformation of the thin film portion.

9. The air cell according to claim 8, wherein the detecting means has:

a first contact member which moves downwardly by being pushed by the thin film portion from the upper side; and a second contact member to which the first contact member which has moved downwardly contacts.

10. The air cell according to claim 8, wherein the detecting means has:

a first contact member which moves downwardly by being pushed by the thin film portion from the upper side;

a second contact member to which the first contact member which has moved downwardly contacts, the second contact member which moves downwardly by being pushed by the first contact member from the upper side; and a third contact member to which the second contact member which has moved downwardly contacts.

11. The air cell according to claim 3, wherein the detecting means is capable of detecting that a distance between the detecting means and the thin film portion is equal to or smaller than a predetermined amount.

12. The air cell according to claim 8, further comprising:

a pressure sensor capable of detecting the pressure of the air in the air chamber.

* * * * *